United States Patent [19]

Harbom

[11] Patent Number: 4,581,857

[45] Date of Patent: Apr. 15, 1986

[54] EAVES TROUGHING ASSEMBLY

[75] Inventor: John Harbom, Brampton, Canada

[73] Assignee: Plastmo Ltd, Bramalea, Canada

[21] Appl. No.: 696,145

[22] Filed: Jan. 29, 1985

[30] Foreign Application Priority Data

Oct. 12, 1984 [CA] Canada ..... 465376

[51] Int. Cl.[4] ..... E04D 13/04

[52] U.S. Cl. ..... 52/12; 52/11; 248/48.2; 405/118; 405/122

[58] Field of Search ..... 52/11–16; 405/118, 122; 248/48.1, 48.2

[56] References Cited

U.S. PATENT DOCUMENTS

| | | | |
|---|---|---|---|
| 2,948,083 | 8/1960 | Steele | 52/12 |
| 3,189,304 | 6/1965 | Vranyosovics | 248/48.2 |
| 3,295,803 | 1/1967 | Blayden | 52/11 |
| 3,430,447 | 3/1969 | Boniface | 405/122 |
| 4,257,716 | 3/1981 | Woodrow | 52/11 |

FOREIGN PATENT DOCUMENTS

| | | | |
|---|---|---|---|
| 1077232 | 5/1980 | Canada | 248/48.1 |
| 2034032 | 1/1972 | Fed. Rep. of Germany | 52/11 |
| 2735975 | 2/1979 | Fed. Rep. of Germany | 52/11 |

*Primary Examiner*—Alfred C. Perham

*Attorney, Agent, or Firm*—Robert F. Delbridge; Arne I. Fors

[57] ABSTRACT

An eaves troughing assembly includes elongated eaves troughing members of resilient material with generally U-shaped section having a rear portion, base portion and front portion, the front portion of each eaves troughing member having a longitudinally extending recess in a front face at least adjacent an end of the member. Elongated connectors of resilient material with generally U-shaped section have a rear connector portion having an inwardly extending upper free end portion forming a recess between the free end portion and an adjacent part of the rear connector to receive an upper end of the rear portion of an eaves troughing member. The front portion of each connector member has a longitudinally extending projection in a rear face shaped for snapping engagement in the recess of an eaves troughing member. A connector member can be assembled with adjacent eaves troughing members, when they are longitudinally aligned with each other with ends substantially abutting, by initially causing the upper ends of the rear portions of the eaves troughing members to be received within the recess of the connector, with the remainder of the connector being below the eaves troughing members. The connector is then moved angularly upwardly relatively to the eaves troughing member to cause longitudinal projection of the connector to move into the recesses in the front faces of the front portions of the eaves troughing members and snap into engagement therewith with the rear portion, base portion and front portion of the connector engaging the corresponding portions of the eaves troughing members.

12 Claims, 9 Drawing Figures

EAVES TROUGHING ASSEMBLY

This invention relates to eaves troughing assemblies.

It is common practice for eaves troughing assemblies to comprise elongated eaves troughing members of resilient material with generally U-shaped section having a rear portion, base portion and front portion, and connectors of similar section and shaped for engagement with substantially abutting ends of longitudinally adjacent eaves troughing members. The resilient material may be metal or synthetic plastic material, such as polyvinyl chloride (PVC). In such prior eaves troughing assemblies, it is rather common for the connectors to be assembled with each eaves troughing member by longitudinal sliding movement over the end of the eaves troughing member. With such an assembly, installation is difficult because long lengths of eaves troughing have to be moved sideways in mounting brackets during installation.

It is therefore an object of this invention to provide an improved eaves troughing assembly which does not require relative longitudinal sliding movement to secure a connector with an eaves troughing member.

According to the invention, the front portion of each eaves troughing member has a longitudinal extending recess in a front surface thereof at least adjacent an end of the member, and the connectors each have a rear connector portion having an inwardly extending upper free end portion forming a recess between the free end portion of an adjacent part of the rear connector portion to receive an upper end of the rear portion of an eaves troughing member, and the front portion of the connector member has a longitudinal extending projection in a rear face thereof shaped for snapping engagement in the recess of an eaves troughing member. A connector can be assembled with a pair of eaves troughing members, when the members are longitudinally aligned with each other with ends substantially abutting, by causing the upper ends of the rear portions of the eaves troughing members to be received within the recess of the connector, with the remainder of the connector being below the eaves troughing members. The connector member is then moved angularly upwardly relative to the eaves troughing members to cause a longitudinal projection of the connector to move into the recesses in the front faces of the front portions of the eaves troughing members, and snap into engagement therewith with the rear portion, base portion and front portion of the connector engaging the corresponding portions of the eaves troughing members.

Thus, a number of eaves troughing members may be secured in place with their ends abutting, with the connectors being snapped into place thereafter. Each connector may be constructed so that its rear portion, base portion and front portion tightly engage the corresponding portions of adjacent eaves troughing member to reduce likelihood of water leakage from the eaves troughing. Also, appropriate adhesive, cement or other sealing material may be applied to the inner surfaces of each connector before it is installed.

The front connector portion of the connector may have an inwardly extending free end portion shaped to snap over upper ends of the front portions of adjacent eaves troughing members when the connector is assembled therewith.

The longitudinal extending projection on the rear face of the front protion of the connector may have an upper edge shaped for substantially greater snapping action into engagement with corresponding upper edges of the recesses in the eaves troughing members than a lower edge which is shaped for substantially less snapping action into engagement with corresponding lower edges of the recesses in the eaves troughing members.

An eaves troughing assembly in accordance with the invention may also include at least one transversely elongated bracket securable to a support, each bracket having a downwardly extending recess adjacent a rear end for receiving and retaining an upper end of the rear portion of an eaves troughing member and an upward projection at a front end, the front portion of each eaves troughing member having an inwardly bent upper end portion securable over the upward projection of the bracket to retain the eaves troughing member in engagement therewith when the upper end of the rear portion of the eaves troughing member is retained in the bracket recess.

The bracket may have retaining means on an upper portion of its rear end operable in association with the inwardly extending upper end portion of an eaves troughing member secured thereto to retain a screen member therebetween with the screen member extending across the eaves troughing member.

Advantageously, the eaves troughing members and the connector are extrusions of synthetic platic material, such as PVC.

One embodiment of the invention will now be described, by way of example, with reference to the accompanying drawings, of which:

Figure 3:
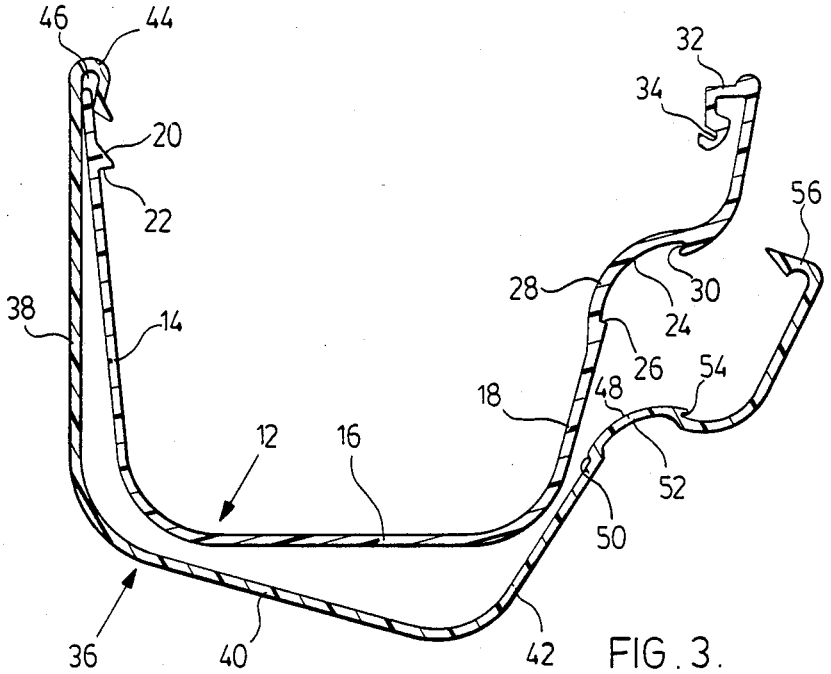
Figure 4:
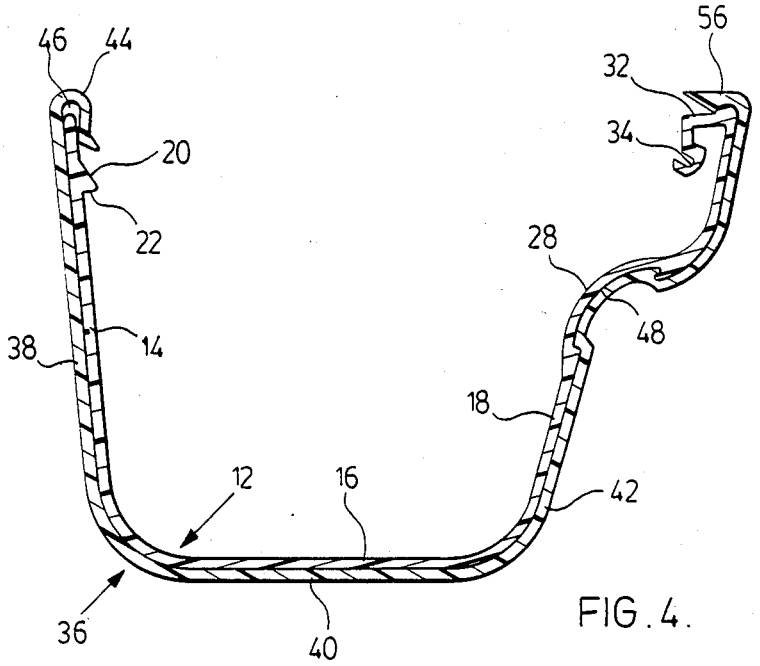
Figure 5:
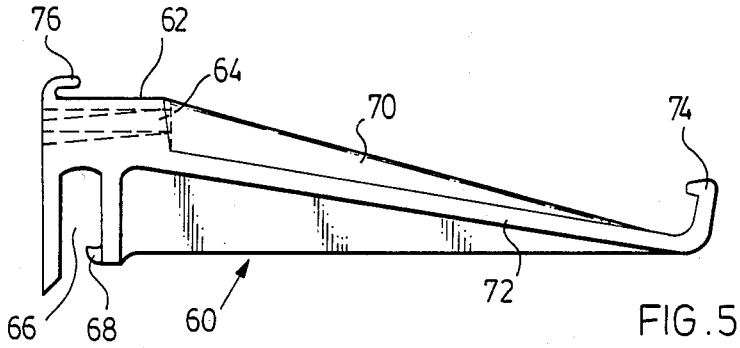
Figure 6:
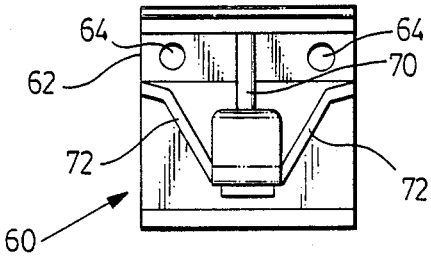
Figure 7:
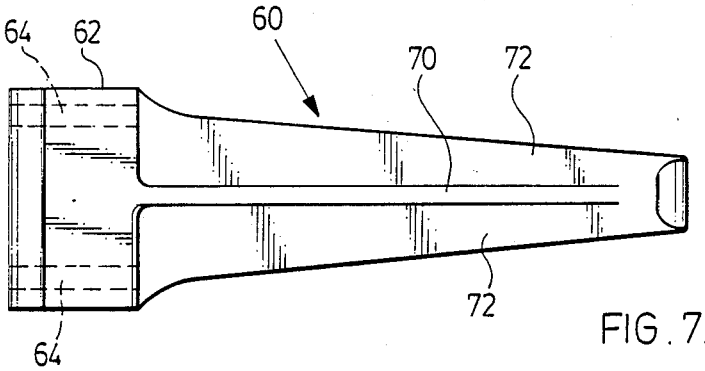
Figure 8:
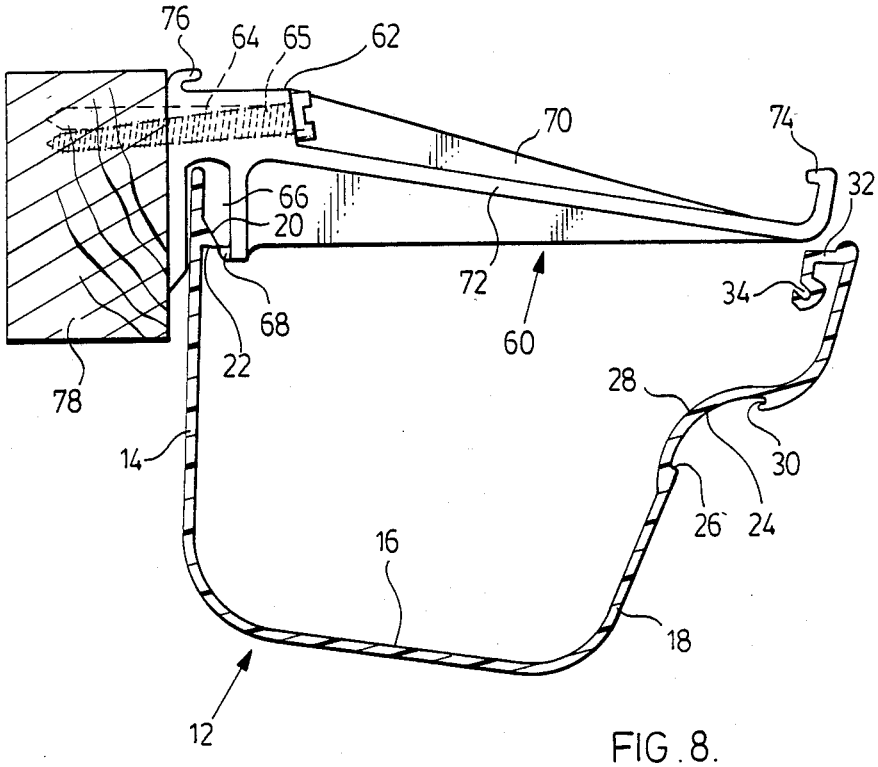
Figure 9:
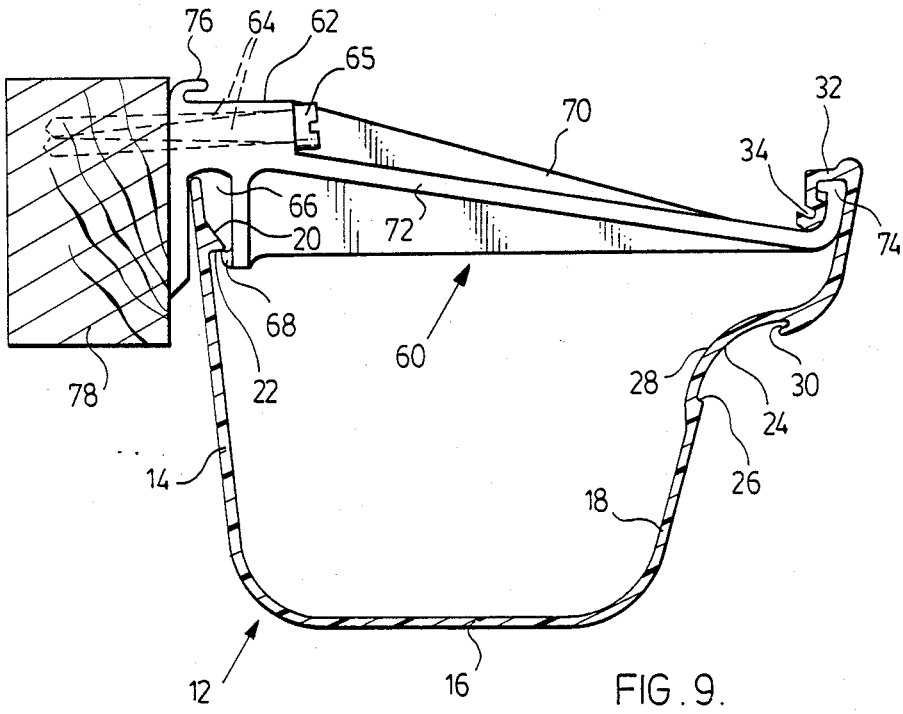

FIG. 3 is a similar view of an initial stage of engagement of a connector with an end of eaves troughing member, FIG. 4 is a similar view showing the connector fully engaged with the eaves troughing member, FIG. 5 is an end view of a bracket, FIG. 6 is a front view of the bracket FIG. 7 is a plan view of the bracket, FIG. 8 is a side view showing an initial stage of engagement of an eaves troughing member with the bracket, and FIG. 9 is a similar view showing the eaves troughing member fully engaged with the bracket.

Figure 1:
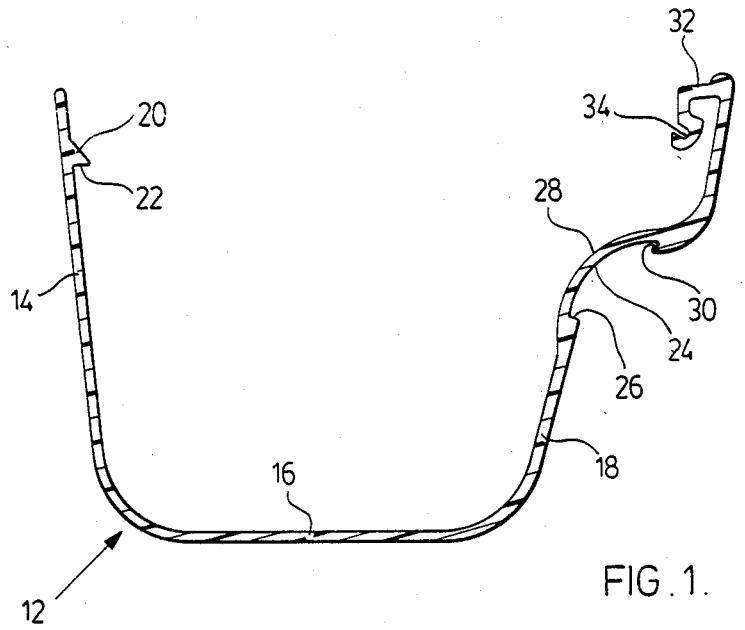
FIG. 1 is an end view of an eaves troughing member.

Referring to the drawings, FIG. 1 shows a resilient eaves troughing member 12 of extruded PVC with a generally U-shaped section having a rear portion 14, base portion 16 and front portion 18, the various portions merging with one another through rounded corners. The rear portion 14 is slightly outwardly inclined in an upward direction, and the inner surface of the rear portion 14 has a longitudinal extending rib 20 with a downwardly facing lower surface 22 for a purpose to be described. The base portion 16 is horizontal. The front portion 18 is upwardly and outwardly inclined and, at about mid-height position, has an outwardly curved medial portion with a longitudinally extending recess 24 in its front surface. The recess 24 has a slightly re-entrant lower edge 26, a concavely curved major surface 28 and a considerably re-entrant upper edge 30. The front portion also has an inwardly extending upper end part 32 with an inwardly facing recess 34 for a purpose to be described.

Figure 2:
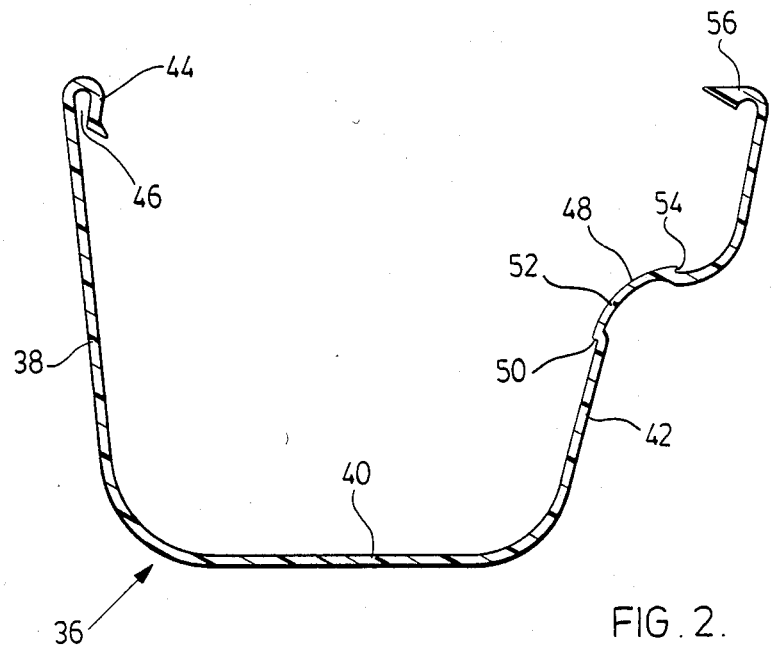
FIG. 2 is a similar view of a connector.

FIG. 2 shows a resilient connector 36 also of extruded PVC with a generally U-shaped section having a rear portion 38, base portion 40 and front portion 42, the various portions merging with one another through rounded corners. The rear portion 38 is slightly outwardly inclined in an upward direction, and has an inwardly bent upper free end portion 44 forming a recess 46 with the adjacent part of the rear portion 38. The base portion 40 is horizontal. The front portion 42 is upwardly and outwardly inclined, and at about mid-height, has an outwardly curved medial portion with a longitudinally extending projection 48 in its rear surface. The projection 48 has a lower edge 50, a concavely curved major surface 52 and upper edge 54 shaped in a complimentary manner to the corresponding parts of recess 24 in the eaves troughing member 12. The front portion 42 also has an inwardly extending upper free end part 56.

To assemble a connector 36 with the abutting ends of a pair of longitudinally adjacent eaves troughing members 12, the connector 36 is brought under the eaves troughing member 12 and the inwardly bent upper free end part 44 of the rear portion 38 is pulled down over the upper ends of the rear walls 14 of the eaves troughing members 12, as shown in FIG. 3 so that the upper ends of the rear walls 14 enter the recess 46. By hinging the upper end of the rear portion 38 of the connector 36 about the upper ends of the rear portions 14 of the eaves troughing members 12, the connector 36 is moved angularly upwardly relative to the eaves troughing members 12 to cause the projection 48 on the front portion 42 of the connector 36 to snap into the recess 24 in the front portions 18 of the eaves troughing members 12. With such upward movement, the lower edge 50 of the projection 48 hinges on the lower edge 26 of the recess 24, and the curved major surface 28 of the recess 24 then straightens somewhat to permit the upper considerably re-entrant edge 54 of the projection 48 to snap into engagement with the upper edge 30 of the recess 24, with the major surface 28 of the recess 24 tending to return to its original curved shape and therefore retain the connector 36 securely in engagement with the eaves troughing members 12 as shown in FIG. 4. At the same time, the upper free end part 56 of the front portion 42 of the connector 36 snaps over the upper end of the front portions 18 of the eaves troughing members 12, thereby further securing the assembly.

The connector 36 is constructed so that, when assembled with the eaves troughing members 12, its rear portion 38, base portion 40 and rear portion 42 tightly engage the corresponding portions of the eaves troughing members 12. The rounded corners between the various portions facilitate such engagement, which reduces the likelihood of water leakage from the eaves troughing. A suitable sealing material, such as PVC cement, can be applied to the inner surfaces of the connector 36 before assembly for the same purpose.

Referring now to FIGS. 5 to 7, the eaves troughing assembly also incudes a number of brackets 60 for securing the eaves troughing members 12 to a support. Each bracket 60 is of molded PVC with a rear body portion 62 having two longitudinally spaced holes 64 near the top and extending from front to rear for receiving screws 65 to enable the bracket 60 to be secured to a support. The lower part of the rear body portion 62 has a downwardly open recess 66 having a small ledge 68 at the lower end of its front wall for a purpose to be described. A tapering vertical wall 70 extends forwardly from the rear body portion 62, and a pair of wing portions 72 extend on opposite sides of the wall 70, the wing portions 72 extending in a downwardly inclined direction from the rear body portion 62 to the front end of the bracket 60. At the front end, the wing portions 72 curve into an upward projection 74. The top of the rear body portion 62 has a forwardly facing hook 76 for a purpose to be described.

Referring now to FIG. 8, brackets 60 are secured to a faciaboard support 78 by screws 65, which provide rigidity and strength over the recess 66. It will be noted that the rear body portion 62 is thick in the region of the apertures 64, i.e. wider than the recess 66, so that the screws 65 extend well past the recess 66, thus making the bridging over the recess 66 rigid.

An eaves troughing member 12 is secured to bracket 60 (after they have been secured by screws to a support structure at suitable intervals) by first pushing the upper end of the rear portion 14 of the eaves troughing member 12 into the recess 66 in the rear body portion 62 of the bracket 60, as shown in FIG. 8, until the rib 20 passes the ledge 68 so that the rib surface 22 rests on ledge 68. The eaves troughing member 12 is swung upwardly, with the rib 20 pivoting on the ledge 68 to cause the inwardly extending upper end portion 32 of the front portion 18 of the eaves troughing member 12 to snap over the projection 74 on the front of the bracket 60, thereby firmly securing the eaves troughing member to the bracket 60 as shown in FIG. 9.

If desired, a screen (not shown) can be fitted in the hook 76 on the rear body portion 62 of the bracket 60 and the recess 34 in the inwardly extending upper end part 32 of the front portion 18 of the eaves troughing member 12 so as to extend over the top of the eaves troughing member 12 to prevent leaves, etc. from falling therein.

The advantages of the invention will be readily apparent to a person skilled in the art from the foregoing description of a preferred embodiment. Other embodiments of the invention will also be readily apparent to a person skilled in the art, the scope of the invention being defined in the appended claims.

What we claim as new and desire to protect by Letters Patent of the United States is:

1. An eaves troughing assembly comprising a pair of elongated eaves troughing members of resilient synthetic plastic material with generally U-shaped section having a rear portion, base portion, and front portion, the front portion of each eaves troughing member having a longitudinally extending recess in a front face thereof at least adjacent an end of the member, and an elongated connector of resilient synthetic plastic material with generally U-shaped section, having a rear portion, base portion and front portion, the rear connector portion having an inwardly extending upper free end portion forming a recess between free end portion and an adjacent part of the rear connector to receive an upper end of the rear portion of an eaves troughing member, and the front portion of the connector having a longitudinally extending projection in a rear face thereof shaped for snapping engagement in the recess of an eaves troughing member to enable the connector member to be assembled with the eaves troughing members, said members being longitudinally aligned with each other with ends substantially abutting, the upper ends of the rear portions of the eaves troughing members being received within the recess of the connector, with the remainder of the connector being below the eaves troughing members, and the longitudinally projection of the connector being in snapping engagement in the recesses in the front faces of the front portions of the eaves throughing members, with the rear portion, base portion and front portion of the connector engaging the corresponding portions of the eaves troughing members.

2. An eaves troughing assembly according to claim 1 wherein the front connector portion of the connector has an inwardly extending free end portion snapped over upper ends of the front portions of adjacent eaves troughing members.

3. An eaves troughing assembly according to claim 1 wherein the longitudinally extending projection of the rear face of the front portion of the connector has an upper edge shaped for substantially greater snapping action into engagement with corresponding upper edges of the recesses in the eaves troughing members than a lower edge which is shaped for substantially less snapping action into engagement with corresponding lower edges of the recesses in the eaves troughing members.

4. An eaves troughing assembly according to claim 1 including at least one transversely elongated bracket securable to a support, each bracket having a downwardly open recess adjacent a rear end in which an upper end of the rear portion of an eaves troughing member is received, and means in the recess retaining said upper end in the recess, each bracket also having an upward projection at a front end, the front portion of each eaves troughing member having an inwardly bent upper end portion secured over the upward projection of the bracket and retaining the eaves troughing member in engagement therewith, and at least one screw-receiving aperture in an upper portion of its rear end, said upper portion being above and wider than the downwardly extending recess to enable the bracket to be secured to a support by one or more screws which consequently provide rigidity in the rear body portion above the recess.

5. An eaves troughing assembly according to claim 4 wherein the bracket has a retaining means on an upper portion of its rear end operable in association with the inwardly extending upper end portion of an eaves troughing member to retain a screen member therebetween with the screen member extending across the eaves troughing member.

6. An eaves troughing assembly according to claim 1 wherein the front portion of each eaves troughing member and the front portion of the connector each has an outwardly curved medial portion, the outwardly curved medial portions of the eaves troughing members having said longitudinally extending recesses and the outwardly curved medial portion of the connector having said longitudinally extending projection.

7. An eaves troughing kit comprising a pair of elongated troughing members of resilient synthetic plastic material with generally U-shaped section having a rear portion, base portion and front portion, the front portion of each eaves troughing member having a longitudinally extending recess in a front face thereof at least adjacent an end of the member, and an elongated connector of resilient synthetic plastic material with generally U-shaped section, having a rear portion, base portion and front portion, the rear connector portion having an inwardly extending upper free end portion forming a recess between the free end portion and an adjacent part of the rear connector adapted to receive an upper end of the rear portion of an eaves troughing member, and the front portion of the connector having a longitudinal extending projection in a rear face thereof adapted to be snapped into the recess of an eaves troughing member, whereby the connector member can be assembled with the eaves troughing members, when said members are longitudinally aligned with each other with ends substantially abutting, by causing the upper ends of the rear portions of the eaves troughing members to be received within the recess of the connector, with the remainder of the connector being below the eaves troughing members, and moving the connector angularly upwardly relatively to the eaves troughing members to cause the longitudinal projection of the connector to move into the recesses in the front faces of the front portions of the eaves troughing members and snap into engagement therewith, with the rear portion, base portion, and front portion of the connector engaging the corresponding portions of the eaves troughing members.

8. An eaves troughing kit according to claim 7 wherein the front connector portion of the connector has an inwardly extending free end portion adapted to snap over upper ends of the front portions of adjacent eaves troughing members when the connector is being assembled therewith.

9. An eaves troughing assembly according to claim 7 wherein the longitudinally extending projection of the rear face of the front portion of the connector has an upper edge adapted to snap into engagement with corresponding upper edges of the recesses in the eaves troughing members with a substantially greater snapping action than a lower edge which is adapted to snap into engagement with the corresponding lower edges of the recesses in the eaves troughing members with a substantially less snapping action.

10. An eaves troughing kit according to claim 7 including at least one transversely elongated bracket securable to a support, each bracket having a downwardly open recess adjacent a rear end adapted to receive an upper end of the rear portion of an eaves troughing member, means in the recess adapted to retain said upper end in said recess, each bracket also having an upward projection at a front end, the front portion of each eaves troughing member having an inwardly bent upper end portion adapted to be secured over the upward projection of the bracket to retain the eaves troughing member in engagement therewith when the upper end of the rear portion of the eaves troughing member is retained in the bracket recess, and at least one screw-receiving aperture in an upper portion of its rear end, said upper portion being above and wider than the downwardly extending recess to enable the bracket to be secured to a support by one or more screws when consequently provide rigidity in the rear body portion above the recess.

11. An eaves troughing kit according to claim 10 wherein the bracket has a retaining means on an upper portion of its rear end adapted, in association with the inwardly extending upper end portion of an eaves troughing member when secured thereto, to retain a screen member therebetween with the screen member extending across the eaves troughing member.

12. An eaves troughing kit according to claim 7 wherein the front portion of each troughing member and the front portion of the connector each has an outwardly curved medial portion, the outwardly curved medial portions of the eaves troughing members having said longitudinally extending recesses and the outwardly curved medial portion of the connector having said longitudinally extending projection.

* * * * *